US007154215B2

(12) United States Patent
Kim

(10) Patent No.: US 7,154,215 B2
(45) Date of Patent: Dec. 26, 2006

(54) COLOR CATHODE RAY TUBE CAPABLE OF REDUCING STRESS

(75) Inventor: Sung Hun Kim, Busankwangyuk-si (KR)

(73) Assignee: LG. Philips Displays Korea Co., Ltd., Gumi-si (KR)

( * ) Notice: Subject to any disclaimer, the term of this patent is extended or adjusted under 35 U.S.C. 154(b) by 51 days.

(21) Appl. No.: 10/855,412

(22) Filed: May 28, 2004

(65) Prior Publication Data

US 2005/0052113 A1 Mar. 10, 2005

(30) Foreign Application Priority Data

Sep. 5, 2003 (KR) ..... 10-2003-0062155
Nov. 11, 2003 (KR) ..... 10-2003-0079500

(51) Int. Cl.
*H01J 29/70* (2006.01)

(52) U.S. Cl. ..... 313/440; 313/447 R; 220/2.1 A; 220/2.3 A

(58) Field of Classification Search ..... 313/477 R, 313/440, 461, 467; 220/2.1 R, 2.3
See application file for complete search history.

(56) References Cited

U.S. PATENT DOCUMENTS

| | | | | |
|---|---|---|---|---|
| 6,677,702 | B1 * | 1/2004 | Kim et al. | 313/477 R |
| 6,825,602 | B1 * | 11/2004 | Lee | 313/440 |
| 6,841,927 | B1 * | 1/2005 | Lee | 313/474 |
| 6,847,160 | B1 * | 1/2005 | Kim | 313/477 R |
| 6,876,138 | B1 * | 4/2005 | Baek | 313/440 |
| 2003/0030364 | A1 * | 2/2003 | Ko | 313/477 R |
| 2005/0052114 | A1 * | 3/2005 | Kim | 313/477 R |

* cited by examiner

*Primary Examiner*—Nimeshkumar D. Patel
*Assistant Examiner*—Hana Sanei
(74) *Attorney, Agent, or Firm*—Birch, Stewart, Kolasch & Birch, LLP

(57) ABSTRACT

A color cathode ray tube has features to decrease mechanical stress due to internal pressure made by evacuation. The cathode ray tube includes a panel on an inner surface of which a phosphor screen is formed. A funnel is joined to the panel. An electron gun generates electron beams, and a deflection yoke is mounted within the funnel to deflect the electron beams. The panel satisfies a condition: $L1+(L2-L1)\times 0.35 \leqq L \leqq L1+(L2-L1)\times 0.45$, and more preferably a condition: $L1+(L2-L1)\times 0.35 \leqq L < L1+(L2-L1)\times 0.45$, wherein L1 is a distance between an inner center P of said panel and a yoke line plane; L2 is a distance between the inner center P of said panel and a neck line plane; and L is a distance between the inner center P of said panel and a reference line plane.

17 Claims, 4 Drawing Sheets

COLOR CATHODE RAY TUBE CAPABLE OF REDUCING STRESS

This Non-provisional application claims priority under 35 U.S.C. 119(a) on Patent Application No(s). 10-2003-0062155 and 10-2003-0079500 filed in Korea on Sep. 5, 2003 and Nov. 11, 2003, the entire contents of which are hereby incorporated by reference.

TECHNICAL FIELD

The present invention relates to a color cathode ray tube and more specifically to a color cathode ray tube in which mechanical stress due to internal pressure made by evacuation is decreased.

BACKGROUND OF THE INVENTION

FIG. 1 shows a schematic diagram illustrating the structure of a general color cathode ray tube. As shown in FIG. 1, the color cathode ray tube generally includes a glass envelope having a shape of bulb and being comprised of a faceplate panel 1, a tubular neck 13, and a funnel 2 connecting the panel 1 and the neck 13.

The panel 1 comprises faceplate portion and peripheral sidewall portion sealed to the funnel 2. A phosphor screen 4 is formed on the inner surface of the faceplate portion. The phosphor screen 4 is coated by phosphor materials of R, G, and B. A multi-apertured color selection electrode, i.e., shadow mask 3 is mounted to the screen with a predetermined space. The shadow mask 3 is hold by main and sub frames 7 and 8. An electron gun is mounted within the neck 13 to generate and direct electron beams 6 along paths through the mask to the screen.

The shadow mask 3 and the frame 7 constitute a mask-frame assembly. The mask-frame assembly is joined to the panel 1 by means of springs 9.

The cathode ray tube further comprises an inner shield 10 for shielding the tube from external geomagnetism and a reinforcing band 12 attached to the sidewall portion of the panel 10 to prevent the cathode ray tube from being exploded by external shock. The cathode ray tube further comprises external deflection yokes 5 located in the vicinity of the funnel-to-neck junction and a magnet 11 attached to the rear side of the deflection yokes 5 for amending electron bean trajectory.

Process for making the color cathode ray tube comprises generally pre-process and post-process.

During the pre-process, phosphor materials are deposited on the inner surface of the panel.

The post-process comprises further sub processes as follows. Firstly, after the phosphor materials are deposited, sealing process is performed. In the sealing process, a panel to which mask-frame assembly is mounted and a funnel on the inner surface of which frit is deposited is sealed together in a high temperature furnace. Then, evacuating process is performed where electron gun is inserted in the neck. Thereafter, an evacuating and sealing process is performed, in which the cathode ray tube is evacuated and sealed.

Since the cathode ray tube is evacuated, it suffers from high tensile and compressive stress. Therefore, a reinforcing process is conducted where reinforcing band 12 is attached to the panel to distribute the stress over the panel.

FIG. 2 shows a schematic view of distributions of stresses generated in the panel and funnel glasses after the evacuation process. In FIG. 2, dotted and solid lines represent compressive and tensile stresses, respectively.

In general, when a glass gets a shock from outside, cracks appear in the glass. Tensile stress may hasten increase of the cracks such that the glass may even be broken by the cracks. On the contrary, compressive stress disturbs increase of the cracks. As shown in FIG. 2, central portion of the panel gets compressive stress while corner portion and seal line portion get tensile stress. Therefore, the central portion is relatively strong against shock. However, the corner portion and the seal line portion are easily broken by outside shock.

Moreover, the cathode ray tube becomes slim recently. As the cathode ray tube becomes slimmer, stress problem becomes more severe. This is because volume of the panel decreases while the degree of vacuum is not changed as the cathode ray tube becomes slimmer.

Further, the cathode ray tube where the funnel portion where yokes are attached are made to have rectangular shape to reduce power consumption suffers larger tensile stress. Those cathode ray tubes are easily broken during heat treatment processes.

In order to reduce the effect of the tensile stress on the funnel glass, heat treatment is conducted for the cathode ray tube to generate compressive stress for increasing shock tolerance. However, those treatments increase manufacturing costs.

SUMMARY OF THE INVENTION

An object of the present invention is to provide a cathode ray tube where stress is effectively reduced and shock tolerance is achieved.

According to an aspect of the present invention, a cathode ray tube comprises a panel on an inner surface of which a phosphor screen is formed; a funnel joined to the panel; an electron gun generating electron beams; and a deflection yoke which is mounted within the funnel to deflect the electron beams, wherein said panel satisfies a condition: $L1+(L2-L1)\times 0.35 \leqq L \leqq L1+(L2-L1)\times 0.45$, more preferably a condition: $L1+(L2-L1)\times 0.35 \leqq L < L1+(L2-L1)\times 0.45$, wherein L1 is a distance between an inner center P of said panel and a yoke line plane; L2 is a distance between the inner center P of said panel and a neck line plane; and L is a distance between the inner center P of said panel and a reference line plane.

DETAILED DESCRIPTION

Preferred embodiments of the present invention will be described in a more detailed manner with reference to the drawings.

According to an aspect of the present invention, a cathode ray tube comprises a panel on an inner surface of which a phosphor screen is formed; a funnel joined to the panel; an electron gun generating electron beams; and a deflection yoke which is mounted within the funnel to deflect the electron beams, wherein said panel satisfies a condition: $L1+(L2-L1)\times 0.35 \leqq L \leqq L1+(L2-L1)\times 0.45$, more preferably a condition: $L1+(L2-L1)\times 0.35 \leqq L < L1+(L2-L1)\times 0.45$, wherein L1 is a distance between an inner center P of said panel and a york line plane; L2 is a distance between the inner center P of said panel and a neck line plane; and L is a distance between the inner center P of said panel and a reference line plane.

Figure 1:
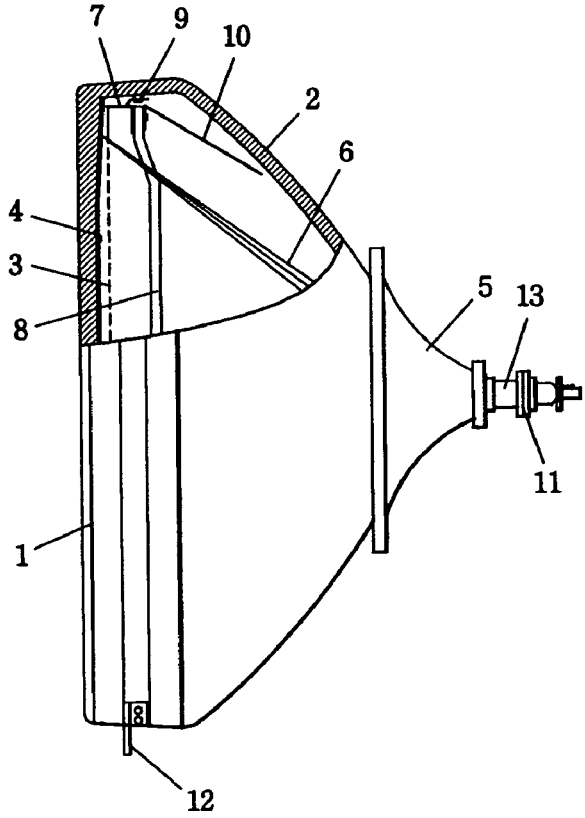
FIG. 1 shows a schematic diagram illustrating the structure of a general color cathode ray tube.
Figure 2:
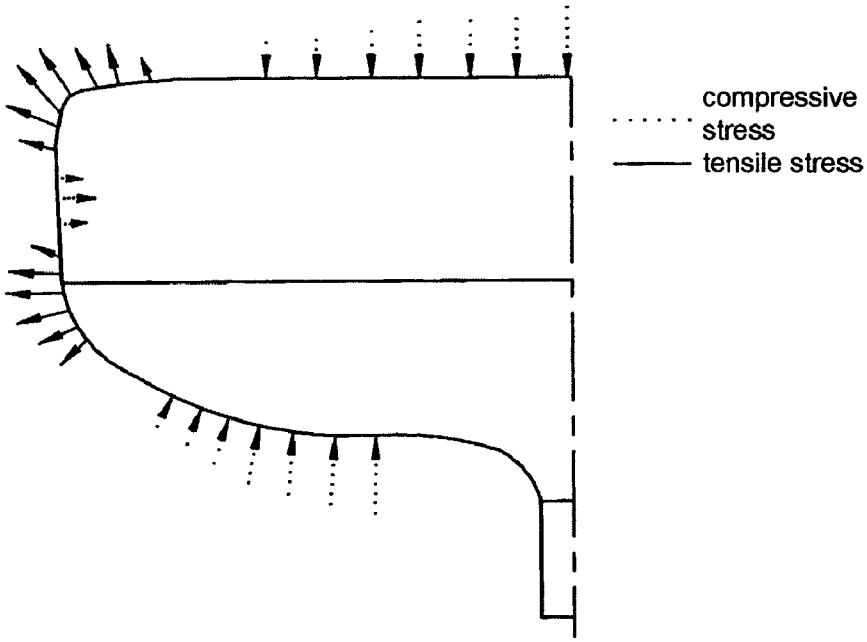
FIG. 2 shows a schematic view of distributions of stresses generated in the panel and funnel glasses after the evacuation process.
Figure 3:
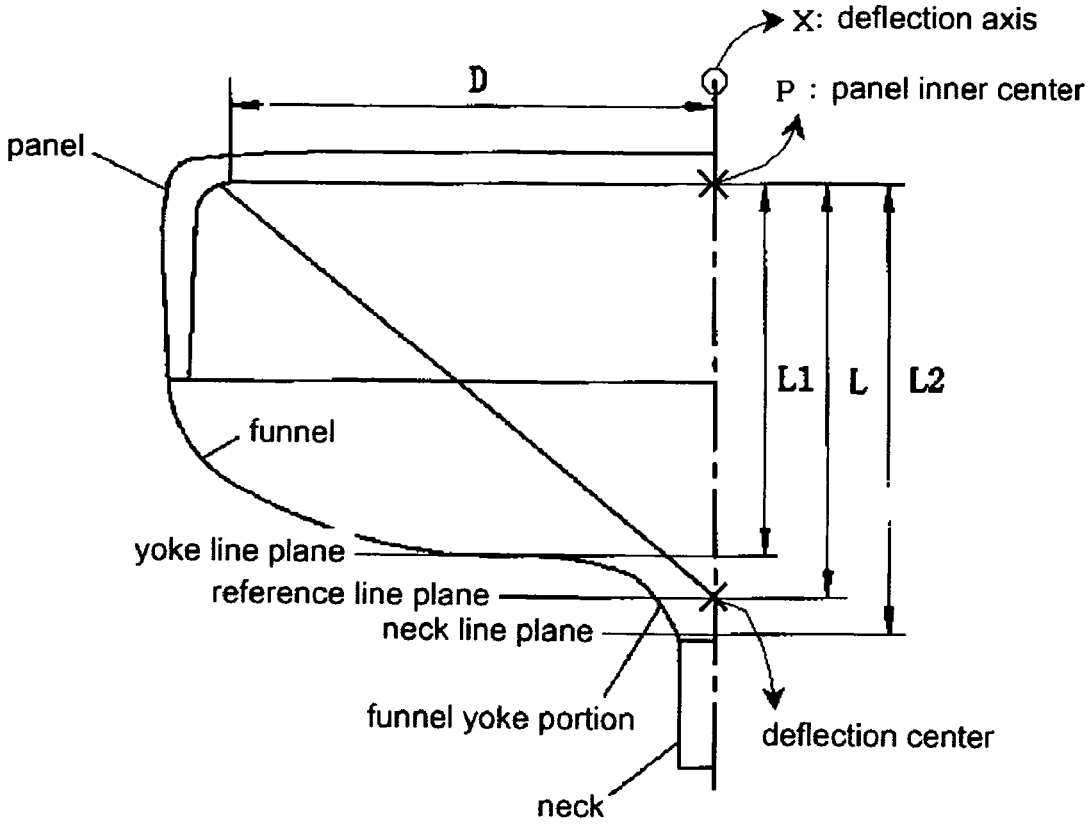
FIG. 3 shows a cross-sectional view of a cathode ray tube according to the present invention.

FIG. 3 shows a cross-sectional view of a cathode ray tube according to the present invention. FIG. 3 is a cross-sectional view of the cathode ray tube taken along line A—A of FIG. 1 and viewing from top.

Hereinafter, the cathode ray tube structure is described by utilizing the following names or terminologies.

Deflection axis X means extension line of the central axis of the electron gun through the screen.

Deflection angle means an angle made with the deflection axis X and a line connecting the deflection center C and a diagonal end of the effective screen.

Panel inner center P means intersection of the deflection center C and the inner surface of the panel.

A cross section of the funnel is a horizontal cross section of the funnel sliced along a horizontal plane including the deflection axis X viewing from top.

A seal line plane is a vertical plane which is perpendicular to the deflection axis X and includes a closed line through which the panel and the funnel is sealed together.

A yoke line plane means a vertical plane which is perpendicular to the deflection axis X and includes a boundary line between the body and yoke portions of the funnel.

A neck line plane means a vertical plane which is perpendicular to the deflection axis X and includes a closed line through which the neck portion and the funnel is sealed together.

A reference line plane means a vertical plane which is perpendicular to the deflection axis X and includes the deflection center.

The present invention relates to the structural aspect of the cathode ray tube defined by position of the yoke line plane, the reference line plane, and the neck line plane by which stress is reduced.

Hereinafter, following parameters are used in the description of the present invention.

D is distance between the panel inner center P and the diagonal end of the effective screen.

L1 is distance between inner center P of the panel and the yoke line plane.

L2 is distance between the panel inner center P and the neck line plane.

L is distance between the panel inner center P and the reference line plane.

Table 1 is the result of an experiment where stress was measured across the funnel for various values of L, L1, and L2 according to the present invention and stress values of the prior art.

TABLE 1

| | conventional | Present invention | | |
|---|---|---|---|---|
| position | 1 | 1 | 2 | 3 |
| L1 (mm) | 250.79 | 164.95 | 145 | 125 |
| L2 (mm) | 322.61 | 222.95 | 203 | 183 |
| L (mm) | 287.11 | 193.71 | 169 | 149 |
| D (mm) | 337.56 | 337.56 | 337.56 | 337.56 |
| L1 + (L2 − L1) * 0.35 (mm) | 275.93 | 185.25 | 165.3 | 145.3 |
| L1 + (L2 − L1) * 0.45 (mm) | 283.11 | 191.05 | 171.1 | 151.1 |
| deflection angle (°) | 100 | 120 | 125 | 135 |
| stress (funnel) | 48.8 MPa | 13.4 MPa | 14.3 MPa | 15.6 MPa |

As shown in Table 1, in the conventional cathode ray tube, deflection angle was 100° and stress was 48.8 MPa. According to the cathode ray tube made by the first parameter sets of the present invention, deflection angle was 120° and stress was 13.4 MPa. According to the first parameter sets, deflection angle was increased while stress was reduced remarkably. Considering the result of the experiment, when following Eqn. 1 is satisfied, L is decreased such that a color cathode ray tube becomes slim, deflection angle is widened, and stress is reduced remarkably.

$$L1+(L2-L1)\times 0.35 \leqq L \leqq L1+(L2-L1)\times 0.45, \text{ more preferably } L1+(L2-L1)\times 0.35 \leqq L < L1+(L2-L1)\times 0.45 \quad \text{Eqn. 1:}$$

Moreover, as shown in Table 1, in the conventional cathode ray tube, L=287.11 mm, D=337.56 mm, and TAN−1(D/L)=0.87. According to the cathode ray tube made by the first parameter sets of the present invention, L=193.71 mm, D=337.56 mm, and TAN−1(D/L)=1.05. According to the cathode ray tube made by the second parameter sets of the present invention, TAN−1(D/L)=1.11. According to the cathode ray tube made by the third parameter sets of the present invention, TAN−1(D/L)=1.16. Therefore, not only limiting L value, but also making TAN−1(D/L)≧1.06. the color cathode ray tube becomes slim, deflection angle is widened, and stress is reduced remarkably.

Further, as shown in Table 1, in the conventional cathode ray tube, deflection angle was 100°. According to the cathode ray tube made by the first parameter sets of the present invention, deflection angle is 120°. According to the cathode ray tube made by the second parameter sets of the present invention, deflection angle is 125°. According to the cathode ray tube made by the third parameter sets of the present invention, deflection angle is 135°. Therefore, not only limiting L value, but also making deflection angle be in the range of 120° to 135°, the color cathode ray tube becomes slim, deflection angle is widened, and stress is reduced remarkably.

Figure 4:
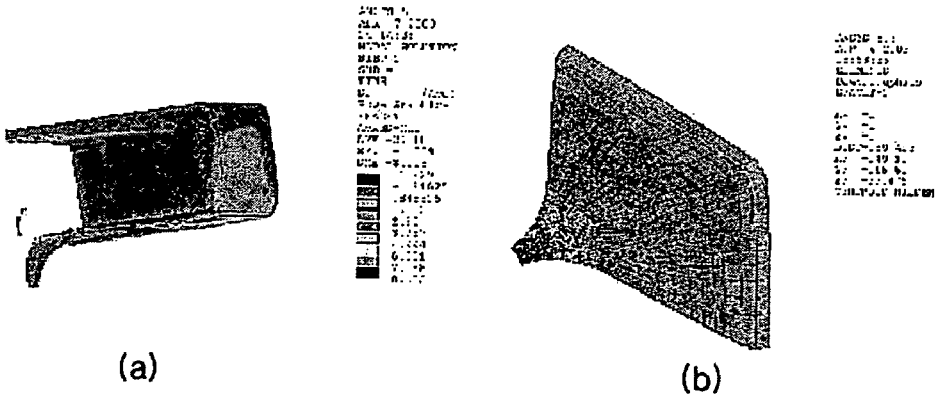
FIGS. 4*a* and 4*b* show a diagram for showing stress and deflection angle distribution analysis.

FIGS. 4*a* and 4*b* shows a diagram for showing stress and deflection angle distribution analysis. As shown in FIGS. 4*a* and 4*b*, when deflection angle is in the range of 120° to 135°, stress is also reduced accordingly.

Figure 5:
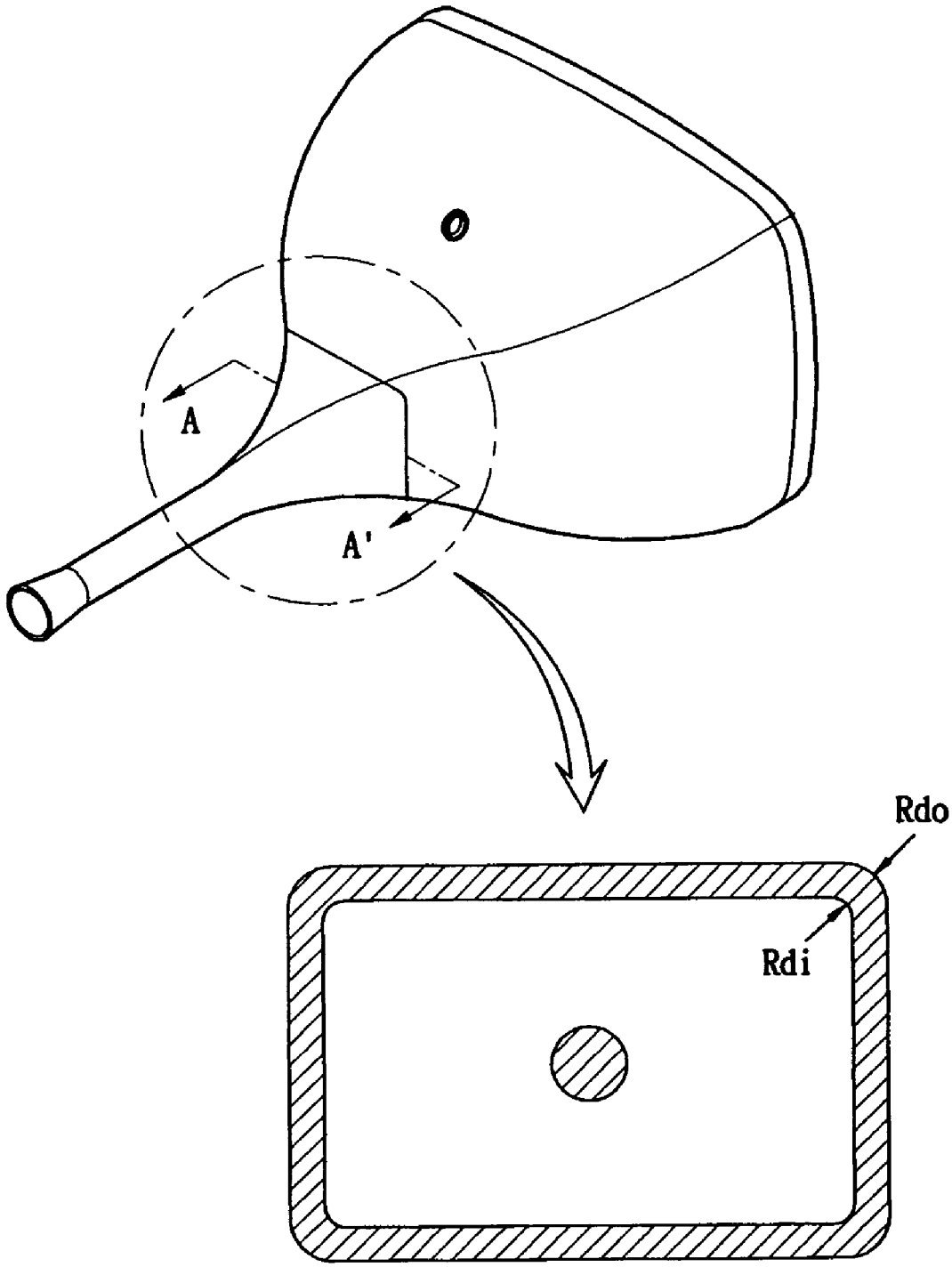
FIG. 5 shows a schematic diagram of a cathode ray tube in accordance with another embodiment of the present invention.

FIG. 5 shows a schematic diagram of a cathode ray tube in accordance with another embodiment of the present invention.

As shown in FIG. 5, cross section of the yoke portion of the funnel has rectangular shape. In comparison with the conventional funnel which has round neck portion, the cathode ray tube of rectangular shape neck portion may consume less power than the conventional one does.

Hereinafter, in the cross section of the neck portion, radius of curvature at one outer corner of the cross section is called Rdo. Whereas, radius of curvature at the inner corner of the cross section is called Rdi.

Table 2 is the result of an experiment where stress was measured across the funnel for various values of Rdo and Rdi according to the present invention and stress values of the prior art.

TABLE 2

| | conventional | present invention | | | |
|---|---|---|---|---|---|
| position | 1 | 1 | 2 | 3 | 4 |
| Rdo (mm) | 27.83 | 27.83 | 30.43 | 27.73 | 32.43 |
| Rdi (mm) | 16.43 | 13.83 | 16.43 | 11.83 | 16.43 |
| SET (mm) | 11.4 | 14 | 14 | 16 | 16 |
| Rdi/Rdo | 0.59 | 0.50 | 0.54 | 0.43 | 0.51 |
| stress (funnel) | 52 Mpa | 16 Mpa | 15 Mpa | 13 Mpa | 12 Mpa |

As shown in Table 2, when Rdi/Rdo satisfies Rdi/Rdo≦0.54, stress is reduced remarkably in comparison with the prior art. Therefore, if Rdi/Rdo is maintained 0.54 or below, a cathode ray tube may be provided where stress is remarkably reduced.

Figure 6:
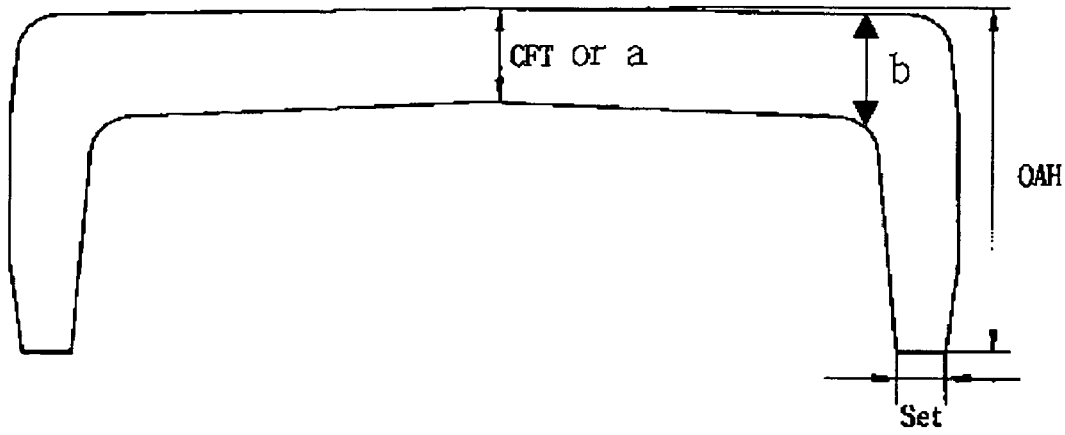
FIG. 6 shows a cross sectional view of the panel according to the present invention.

FIG. 6 shows a cross sectional view of the panel according to the present invention.

Hereinafter, thickness of central panel portion which is intersected by the deflection axis X is defined as a. Thickness of panel at the corner portion is defined as b. Then, b/a is called wedge ratio. According to the present invention, if wedge ratio is no smaller than 1.5, stress is reduced and, additionally, tolerance against shock is increased.

In FIG. 6, thickness of panel portion which is intersected by the deflection axis X is defined as CFT. Thickness of skirt portion of the panel is defined as SET. The overall height of panel structure measured along the deflection axis X is defined as OAH.

Table 3 is the result of an experiment where stress was measured across the panel for various values of CFT, OAH, and SET according to the present invention and stress values of the prior art.

TABLE 3

| | conventional | present invention | | | | |
|---|---|---|---|---|---|---|
| position | 1 | 1 | 2 | 3 | 4 | 5 |
| CFT | 12.5 | 10.5 | 10.5 | 10.5 | 10.5 | 12.5 |
| OAH | 110 | 90 | 90 | 90 | 100 | 110 |
| SET | 11.4 | 13 | 14 | 16 | 11.4 | 12 |
| CFT/SET | 1.10 | 0.81 | 0.75 | 0.66 | 0.92 | 1.04 |
| OAH/SET | 9.65 | 6.92 | 6.43 | 5.63 | 8.77 | 9.17 |
| stress (panel) | 30.5 Mpa | 16.8 Mpa | 14.0 Mpa | 13.6 Mpa | 14.6 Mpa | 15.7 Mpa |

As shown in Table 3, when CFT/SET satisfies CFT/SET≦1.04, stress is remarkably reduced in comparison with the prior art. Thus, if CFT/SET is 1.04 or below, a cathode ray tube may be provided where stress is remarkably reduced.

Moreover, in addition to making CFT/SET to satisfy CFT/SET≦1.04, Rdi/Rdo≦0.54 may further be satisfied. Then, stress is reduced more remarkably.

Further, the every embodiments described hereinabove may be applied to flat type color cathode ray tube where front face surface of panel is substantially flat. Therefore, the effect of the present invention is still effective for the flat type color cathode ray tube.

INDUSTRIAL APPLICABILITY

According to the present invention, a panel and funnel structure is provided which have wide deflection angle and slimmer shape while stress over the funnel is reduced remarkably. Further, the cathode ray tube in accordance with the present invention has larger tolerance against shock in comparison with the prior art.

The invention claimed is:

1. A cathode ray tube comprising:

a panel on an inner surface of which a phosphor screen is formed;

a funnel joined to the panel;

an electron gun generating electron beams; and a deflection yoke which is mounted within the funnel to deflect the electron beams, wherein said panel satisfies a condition:

$$L1+(L2-L1)\times 0.35 \leqq L < L1+(L2-L1)\times 0.45, \text{ wherein}$$

L1 is a distance between an inner center P of said panel and a yoke line plane; L2 is a distance between the inner center P of said panel and a neck line plane; and L is a distance between the inner center P of said panel and a reference line plane.

2. The cathode ray tube of claim 1, wherein said panel satisfies a condition:

$$\mathrm{TAN}^{-1}(D/L) \geqq 1.05, \text{ wherein}$$

D is a distance between the inner center P of said panel and a diagonal end of an effective screen.

3. The color cathode ray tube of claim 1, wherein a deflection angle is in the range of 120° to 135°.

4. The cathode ray tube of claim 1, wherein a cross section of yoke portion of said funnel has substantially a rectangular shape.

5. The cathode ray tube of claim 1, wherein said funnel satisfies a condition:

$$Rdi/Rdo \leqq 0.54$$

wherein a deflection axis means an extension line of the central axis of the electron gun through the screen, a yoke line plane means a vertical plane which is perpendicular to the deflection axis and includes a boundary line between the body and yoke portions of the funnel, Rdo is a radius of curvature at one outer corner of a cross section of the yoke line plane of said funnel, and Rdi is a radius of curvature at one inner corner of the cross section.

6. The cathode ray tube of claim 1, wherein said panel satisfies a condition:

$$CFT/SET \leqq 1.04$$

wherein CFT is a thickness of a central portion of said panel and SET is a thickness of a skirt portion of said panel.

7. The cathode ray tube of claim 5, wherein said panel satisfies a condition:

$$CFT/SET \leqq 1.04$$

wherein CFT is a thickness of a central portion of said panel and SET is thickness of a skirt portion of said panel.

8. The cathode ray tube of claim 1, wherein a wedge ratio of said panel is no smaller than 1.5, wherein the wedge ratio is b/a, b is a thickness of the panel at a corner portion, and a is a thickness of the panel at a central portion.

9. The cathode ray tube according to claim 1, wherein an outer surface of said panel is substantially flat.

10. The cathode ray tube according to claim 1, wherein an outer surface of said panel is substantially flat.

11. A cathode ray tube comprising:

a panel on an inner surface of which a phosphor screen is formed;

a funnel joined to the panel;

an electron gun generating electron beams; and a deflection yoke which is mounted within the funnel to deflect the electron beams, wherein said panel satisfies a condition:

$$L1+(L2-L1)\times 0.35 \leqq L \leqq L1+(L2-L1)\times 0.45, \text{ wherein}$$

L1 is a distance between an inner center P of said panel and a yoke line plane; L2 is a distance between the inner center P of said panel and a neck line plane; and L is a distance between the inner center P of said panel and a reference line plane, and wherein said funnel satisfies a condition:

$$Rdi/Rdo\ 0.54$$

wherein a deflection axis means an extension line of the central axis of the electron gun through the screen, a yoke line plane means a vertical plane which is perpendicular to the deflection axis and includes a boundary line between the body and yoke portions of the funnel, Rdo is a radius of curvature at one outer corner of a cross section of the yoke line plane of said funnel, and Rdi is a radius of curvature at one inner corner of the cross section.

12. The cathode ray tube of claim 11, wherein said panel satisfies a condition:

$$\mathrm{TAN}^{-1}(D/L) \geqq 1.05, \text{ wherein}$$

D is a distance between the inner center P of said panel and a diagonal end of an effective screen.

13. The color cathode ray tube of claim 11, wherein a deflection angle is in the range of 120° to 135°.

14. The cathode ray tube of claim 11, wherein a cross section of a yoke portion of said funnel has substantially a rectangular shape.

15. The cathode ray tube of claim 11, wherein a wedge ratio of said panel is no smaller than 1.5, wherein the wedge ratio is b/a, b is a thickness of the panel at a corner portion, and a is a thickness of the panel at a central portion.

16. The cathode ray tube of claim 11, wherein said panel satisfies a condition:

$$CFT/SET \leqq 1.04$$

wherein CFT is a thickness of a central portion of said panel and SET is a thickness of a skirt portion of said panel.

17. The cathode ray tube of claim 11, wherein said panel satisfies a condition:

$$CFT/SET \leqq 1.04$$

wherein CFT is a thickness of a central portion of said panel and SET is thickness of a skirt portion of said panel.

* * * * *